United States Patent [19]

Björklund et al.

[11] 4,295,113

[45] Oct. 13, 1981

[54] SHEET-WOUND TRANSFORMER OR REACTOR

[75] Inventors: Anders Björklund; Erik Persson; Lars-Göran Virsberg, all of Vesteras, Sweden

[73] Assignee: Asea Aktiebolag, Vesteras, Sweden

[21] Appl. No.: 176,911

[22] Filed: Aug. 11, 1980

[30] Foreign Application Priority Data

Aug. 14, 1979 [SE] Sweden ..... 7906765

[51] Int. Cl.[3] ..... H01F 15/04

[52] U.S. Cl. ..... 336/84 M; 336/177; 336/223; 336/233; 336/234

[58] Field of Search ..... 336/84 R, 84 M, 223, 336/177, 212, 233, 234

[56] References Cited

U.S. PATENT DOCUMENTS 2,962,679 2/1981 Stratton ..... 336/234 X

*Primary Examiner*—Thomas J. Kozma

*Attorney, Agent, or Firm*—Watson, Cole, Grindle & Watson

[57] ABSTRACT

In a transformer or a reactor having at least one winding of foil-formed electrical conductor material, a magnetic-flux-controlling spirally-wound sheet of highly permeable ferro-magnetic material is arranged axially outside each end of the winding. The ends of the sheet are galvanically connected to the foil winding. By division of the magnetic material in the sheet, a high resistance in the longitudinal direction of the sheet, and thus lower losses, are obtained.

10 Claims, 11 Drawing Figures

SHEET-WOUND TRANSFORMER OR REACTOR

BACKGROUND OF THE INVENTION

1. Field of the Invention

The present invention relates to an electrical transformer or reactor having at least one winding of tape-formed conductor material and means for reduction of additional losses in the winding by controlling the magnetic leakage flux appearing axially outside the winding ends.

2. Prior Art

In transformers and reactors having windings of foil-formed electrical conductor material, additional losses in the form of eddy current losses appear at the ends of the windings. The substantially axial magnetic leakage flux passing between the winding turns is deflected in a more or less radial direction at the ends of the windings and passes into the core legs or completes its path outside the windings instead of continuing axially and passing into the yokes. This means that the ends of the windings will be penetrated by a magnetic flux with a radial component, which generates eddy currents in the winding conductor and causes additional losses in excess of the unavoidable ohmic losses which are caused by the normal load current. These eddy current losses raise the temperature in the winding ends so that it may locally assume high values.

Several different measures have been proposed to reduce the radial leakage flux component and thus the losses and the locally high temperatures at the winding ends. U.S. Pat. No. 4,021,764 and 4,012,706, for example, propose the arrangement of ceramically bonded ferrite plates and open rings of electrical sheets, respectively, in the vicinity of the edges of the foil winding, which rings are connected to the different turns in the foil winding. From the point of view of manufacturing technique, however, it is desirable, for example as proposed in British patent specification 2,025,148, to construct such magnetic-flux-controlling bodies in the form of coils coaxial with the winding, which coils are wound together with the foil winding. Electrical sheet has been proposed as material for such coils. To limit the voltage between the foil winding and the magnetic coils upon a short-circuit or a voltage surge, the coils must be galvanically connected to the foil winding, at least at the end points of the coils, possibly also at a number of intermediate points. In view of the losses the magnetic sheet from which the coils are wound must have a resistivity in the longitudinal direction of the sheet of at least $10^{-4}\Omega m$, preferably greater than $5.10^{-4}\Omega m$. At the same time, the permeability of the sheet perpendicular to the longitudinal direction and in the plane of the sheet must be at least 10, preferably greater than 80, and the saturation value of the sheet should be at least 0.4 T, preferably greater than 0.8 T. None of the materials previously proposed for this purpose fulfills these requirements. Thus, electrical sheet has a resistivity which amounts to only about one-thousandth of the required resistivity, and ferrites have a too low saturation value.

SUMMARY OF THE INVENTION

The present invention relates to a transformer or reactor comprising a core, consisting of magnetic material, having at least one leg and one yoke and at least one winding arranged substantially concentrically around the core leg, said winding being built up from a foil, spirally-wound in several turns, of a material having a high electrical conductivity and an insulating film arranged between said turns, a magnetic-flux-controlling spirally-wound tape of a highly permeable ferro-magnetic material being arranged axially outside each end of the winding and coaxially with the winding, connections being arranged between the tape and the winding at the beginning and end of the tape. The purpose of the invention is to provide a transformer or reactor of the above-mentioned kind, in which the magnetic flux-controlling spirally-wound tape arranged at each end of the foil winding has considerably greater resistance in the longitudinal direction of the tape than in corresponding, previously proposed embodiments, while at the same time having a high permeability and a high saturation value across the tape. This is achieved by dividing the magnetic material in the tape in such a way that the ability of the tape to carry electric current in the longitudinal direction of the tape has been considerably reduced.

BRIEF DESCRIPTION OF THE DRAWING

The invention will be described in greater detail with reference to a number of embodiments illustrated in the accompanying drawing, wherein FIG. 1 shows schematically a section through part of the upper portion of a foil winding, arranged around a core leg, provided with a spirally-wound magnetic flux-controlling tape, whereas

DESCRIPTION OF THE PREFERRED EMBODIMENTS

Figure 1:
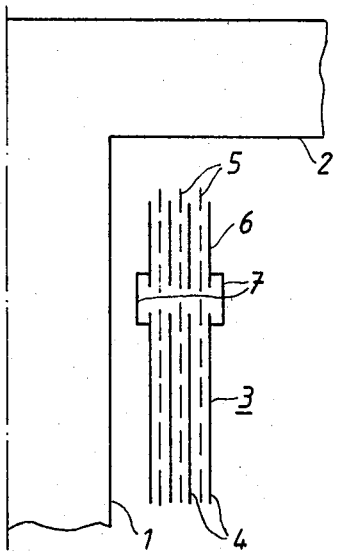

FIG. 1 shows part of a transformer core with core leg 1 and yoke 2. Concentrically around core leg 1 there has been arranged a winding 3 built up of an aluminium foil 4, spirally-wound in several turns on a cylindrical tube (not shown), the thickness of said aluminium foil being between 0.01 and 3 mm, preferably between 0.02 and 1 mm. Between the winding turns there is a film 5 of a suitable insulating material, for example polyethylene glycol terephthalate, the thickness of which may suitably be between 0.01 and 0.05 mm.

Axially outside the end of the winding 3 and coaxially therewith, there is a magnetic flux-controlling spirally-wound tape 6 of a highly permeable ferro-magnetic material. The tape 6 has substantially the same thickness as the aluminium foil 4. The insulating film 5 extends outside the aluminium foil 4 in the axial direction and constitutes insulation also between the turns of the tape 6. Galvanic connections 7 are arranged between the tape 6 and the foil winding 4 at the beginning and end of the tape 6.

Figure 2A:
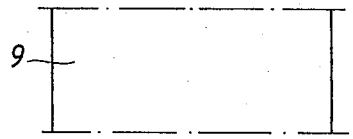
FIGS. 2 to 7 show different embodiments of such tapes.
Figure 2B:
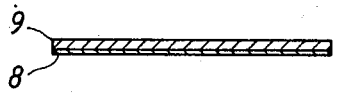

FIGS. 2*a* and *b* show a plane view and a cross-section, respectively, of an embodiment of the tape 6 comprising a layer 9 of a soft-magnetic powder arranged on a supporting film 8 of insulating material, said powder being pressed together with an insulating and cementing binder. To achieve higher permeability in the tape, it is suitable to use powder in the form of oval flakes or wires, which are oriented across the tape.

Figure 3A:
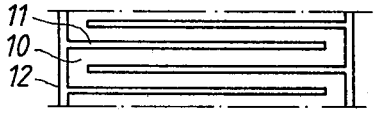

FIGS. 3*a* and *b* show an embodiment of the tape 6 consisting of a soft-magnetic sheet-metal band 10, in which transversely directed slots 11 have been provided alternately from both edges of the band by punching or cutting. The sheet-metal band 10 is fixed, for example by gluing, on a supporting insulating film 12.

Figure 3B:
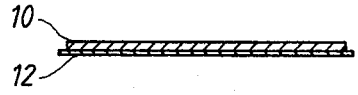

The slotting of the sheet-metal band may be carried out in many different ways. An alternative is shown in FIG. 4 which, similar to FIG. 3, shows a slotted sheet-metal band 13 fixed on an insulating film 14.

Figure 4:
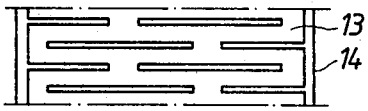
Figure 5:
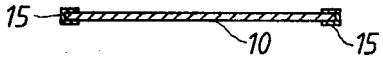

Instead of fixing the sheet-metal bands, shown in FIGS. 3 and 4, on an insulating film which is as wide as the band 6, the sheet-metal bands may be provided with insulating edge strips 15, as shown in FIG. 5.

Figure 6A:
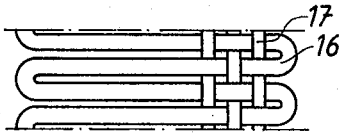
Figure 6B:
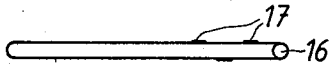

FIGS. 6*a* and *b* show an embodiment of the tape 6 consisting of soft-magnetic round wire 16, which is folded in a loop-formed path running backwards and forwards between the edges of the tape. The wire loops are held together by longitudinal insulating tapes 17 woven into the tape. As an alternative, however, the magnetic wire 16 may be glued to an insulating film (cf. FIG. 3*b*).

Figure 7A:
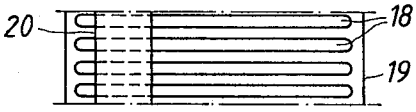
Figure 7B:
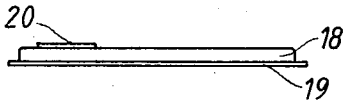

FIGS. 7*a* and *b* show an embodiment of the tape 6, in which cut-off soft-magnetic wires 18, separated from each other, have been glued onto an insulating film 19, the wires being oriented transversely of the tape. Instead of using wires, it is possible to use elongated sheet-metal pieces which are fixed on an insulating film in a corresponding manner. The connection to the foil winding 3 may be made by means of a number of narrow, open electrically conducting tapes 20, in which case, however, each such tape should not follow the magnetic tape 6 for a coherent distance longer than one full turn around the winding. It would also be possible to fix the wires 18 (or said sheet-metal pieces) on the insulating film 19 by means of a high-resistive glue, which simultaneously serves as a potential-controlling connection between wires positioned adjacent each other, the tapes 20 then being eliminated.

We claim:

1. A transformer or reactor comprising:

a core consisting of magnetic material and having at least one leg (1) and one yoke (2);

at least one winding (3) arranged substantially concentrically around said core leg, said winding being built up from a foil (4), spirally-wound in several turns, of a material having a high electrical conductivity and an insulating film (5) arranged between said turns;

a magnetic flux-controlling spirally-wound tape (6) of a highly permeable ferro-magnetic material being arranged axially outside each end of the winding and coaxially therewith, the magnetic material in the tape being divided in such a manner that the ability of the tape to carry electric current in the longitudinal direction of the tape is considerably reduced; and connections (7) being arranged between the tape and the winding at the beginning and end of the tape.

2. Transformer or reactor according to claim 1, wherein the equivalent resistivity of the tape (6) in the longitudinal direction of the tape is greater than $10^{-4}\Omega m$.

3. Transformer or reactor according to claim 1, wherein the tape (6) consists of a layer (9) of a soft-magnetic powder, arranged on a supporting film (8) of insulating material, said powder being pressed together with an insulating and cementing binder.

4. Transformer or reactor according to claim 3, wherein the powder is in the form of oval flakes or wires, which are oriented transversely of the tape.

5. Transformer or reactor according to claim 1, wherein the tape (6) consists of soft-magnetic sheet metal (10, 13), transversely-directed slots (11) being provided alternately from both edges of the tape.

6. Transformer or reactor according to claim 1, wherein the tape (6) consists of soft-magnetic round wire (16) which is folded in a path running backwards and forwards between the edges of the tape (6).

7. Transformer or reactor according to claim 5, wherein the magnetic materials(10, 13, 16) of the tape (6) are fixed, for example by gluing, to a supporting film (12) of insulating material.

8. Transformer or reactor according to claim 5, wherein the magnetic material (16) of the tape (6) is held together by longitudinal insulating tapes (17) woven into the tape.

9. Transformer or reactor according to claim 1, wherein the tape (6) consists of elongated elements (18), for example wires or sheet-metal strips, of soft-magnetic material, arranged on a supporting film (19) of insulating material and oriented transversely of the tape, adjacently positioned elements (18) being galvanically connected to each other and to the winding.

10. Transformer or reactor according to claim 9, wherein said magnetic elements (18) are fixed on the insulating film (19) by means of a high-resistive glue which at the same time serves as a potential-controlling connection between adjacently positioned elements (18).

* * * * *